US009750318B2

(12) United States Patent
Rao

(10) Patent No.: US 9,750,318 B2
(45) Date of Patent: Sep. 5, 2017

(54) MISTER EQUIPPED UMBRELLA SYSTEM

(71) Applicant: Raj Rao, Newport Coast, CA (US)

(72) Inventor: Raj Rao, Newport Coast, CA (US)

( * ) Notice: Subject to any disclaimer, the term of this patent is extended or adjusted under 35 U.S.C. 154(b) by 0 days.

(21) Appl. No.: 14/967,670

(22) Filed: Jan. 4, 2016

(65) Prior Publication Data

US 2017/0196323 A1 Jul. 13, 2017

Related U.S. Application Data

(63) Continuation-in-part of application No. 14/614,643, filed on Feb. 5, 2015, now abandoned, which is a continuation-in-part of application No. 13/468,950, filed on May 10, 2012, now abandoned.

(60) Provisional application No. 61/523,523, filed on Aug. 15, 2011.

(51) Int. Cl.

| | |
|---|---|
| ***A45B 23/00*** | (2006.01) |
| ***A45B 25/18*** | (2006.01) |
| ***A45B 25/06*** | (2006.01) |
| ***A45B 25/14*** | (2006.01) |

(52) U.S. Cl.

CPC ..... *A45B 25/18* (2013.01); *A45B 25/06* (2013.01); *A45B 25/143* (2013.01); *A45B 2025/183* (2013.01); *A45B 2200/1045* (2013.01); *A45B 2200/1081* (2013.01)

(58) Field of Classification Search

CPC ..... A45B 2200/1045; A45B 25/22
USPC ..... 135/15.1, 16; 239/289
See application file for complete search history.

(56) References Cited

U.S. PATENT DOCUMENTS

| | | | | |
|---|---|---|---|---|
| 3,456,661 | A * | 7/1969 | Farley | A45B 25/22 135/33.7 |
| 5,143,107 | A * | 9/1992 | Kelley | A45B 3/00 135/16 |
| 6,196,241 | B1 * | 3/2001 | Doolan | A45B 25/18 135/16 |
| 6,298,866 | B1 * | 10/2001 | Molnar, IV | A45B 3/00 108/50.12 |
| 6,682,000 | B1 * | 1/2004 | Apple | A45B 3/00 239/16 |
| 6,811,100 | B2 * | 11/2004 | Bardinet | A47L 1/08 239/197 |
| 6,886,759 | B1 * | 5/2005 | Okronick | A45B 3/00 239/16 |

(Continued)

FOREIGN PATENT DOCUMENTS

| | | | |
|---|---|---|---|
| WO | WO 2013160510 A1 * | 10/2013 | A45B 25/00 |

*Primary Examiner* — Noah Chandler Hawk
(74) *Attorney, Agent, or Firm* — Rosenberg, Klein & Lee

(57) ABSTRACT

A mister-equipped umbrella to shield a user from precipitation, to provide protection from harmful UV rays, and to allow the user to activate a mister having a variable mist head to cool the user on a hot, sunny day. The mister-equipped umbrella generally combines an umbrella assembly and a mister assembly. The umbrella assembly includes a tube, a runner, a plurality of stretchers, a plurality of ribs each terminating in a top, a cover having at least one UV coating, and a handle that has an inner volume for storing batteries and an outer surface that may be insulated for gripping. The mister assembly includes a fluid reservoir, a pump, and a variable mister head. In use, the user may manually adjust the variable mister head to configure a misting pattern and frequency of the mister.

17 Claims, 8 Drawing Sheets

(56) References Cited

U.S. PATENT DOCUMENTS

| | | | | |
|---|---|---|---|---|
| 7,104,270 | B2 * | 9/2006 | Dong | A45B 3/00 135/16 |
| 7,412,984 | B1 * | 8/2008 | Spencer | A45B 3/00 135/16 |
| 7,497,225 | B1 * | 3/2009 | Klein, Jr. | A45B 3/00 135/118 |
| 9,010,346 | B2 * | 4/2015 | Stankiewicz | A45B 23/00 135/16 |
| 9,072,349 | B1 * | 7/2015 | Thompson | A45B 25/00 |
| 2002/0078985 | A1 * | 6/2002 | Farr | A45B 3/00 135/16 |
| 2002/0134412 | A1 * | 9/2002 | You | A45B 25/22 135/15.1 |
| 2005/0161066 | A1 * | 7/2005 | Ma | A45B 23/00 135/16 |
| 2005/0161067 | A1 * | 7/2005 | Hollins | A45B 23/00 135/16 |
| 2008/0048051 | A1 * | 2/2008 | Chang | A45B 3/00 239/289 |
| 2008/0179426 | A1 * | 7/2008 | Johnson | A45B 3/00 239/289 |
| 2013/0213446 | A1 * | 8/2013 | Rao | A45B 3/00 135/16 |
| 2015/0144165 | A1 * | 5/2015 | Rao | A45B 3/00 135/16 |
| 2015/0366305 | A1 * | 12/2015 | Edwards | A45B 25/00 135/16 |

* cited by examiner

MISTER EQUIPPED UMBRELLA SYSTEM

CROSS-REFERENCE TO RELATED APPLICATIONS

The present application is a Continuation-in-Part (CIP) related to and claims priority from prior provisional application Ser. No. 61/523,523, filed Aug. 15, 2011 and pending non-provisional application Ser. No. 13/468,950 filed May 10, 2012 which applications are incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of umbrellas and more specifically relates to an improved multi-functional umbrella comprising a mister having a variably controllable and pivotal mist head.

2. Description of the Related Art

Umbrellas are a handy and useful tool for protecting a user from getting wet from rain and precipitation, and for shielding a user from harmful rays emanating from the sun. People frequently carry with them an umbrella to be used in case of rain or on hot and sunny days. Since umbrellas are very commonplace in different societies, some people like to accessorize by carrying with them a fashionable or stylish umbrella. Alternatively, some people like to use umbrellas that provide other functions in addition to sun blocking and precipitation (rain) protection. Umbrellas may also have a variety of uses. Parasols are often used by beach goers and are planted in the sand to provide protection from the sun while sun bathing. Alternatively, many home owners enjoy sitting outside during the daytime and setting up a large umbrella to cover patio table or lawn chairs. There are virtually limitless uses for conventional umbrellas.

Many prior art umbrellas suffer from lack of durability. The elements of the weather as well as mechanical use or overuse have made existing umbrellas usable for only short periods of time. For example, problems with umbrella inversion, rusting of the frame, ripping of the material with strong gusts of wind, traction and retraction of the metal parts have reduced the longevity of the average umbrella. The embodiments described herein aim to provide a multi-functional and multi-purpose umbrella with increased durability thus allowing owners to enjoy the use of the umbrella longer than what is typical for an umbrella. It is also desirable to provide an umbrella that is aesthetically pleasing which the conventional versions do not. Exposure to the environment may lead to skin cancers, diseases associated with skin discoloration, blistering, pain which may be unpleasant for many suffers. It is desirable that exposure be minimized to avoid these health risks.

Various attempts have been made to solve the above-mentioned problems such as those found in U.S. Pat. No. 6,886,759 to Okronick; U.S. Pat. No. 5,421,354 to Bolton; U.S. Pat. No. 6,682,000 to Apple; U.S. Pat. No. 7,497,225 to Klein, Jr.; U.S. Pat. No. 7,104,270 to Peter Dong; U.S. Pat. No. 5,143,107 to Jean M. Kelley; and U.S. Pub. Nos. 2008/0179426 to Johnson; 2005/0161066 to Joen-Shen Ma; 2002/0078985 to Fariss Farr; and 2008/0048051 to Chang. This prior art is representative of multi-functional umbrellas. None of the above inventions and patents, taken either singly or in combination, is seen to describe the invention as claimed.

Ideally, a mister-equipped umbrella should provide a user with an easy to open, easy to close (user-friendly), durable umbrella equipped with a mister assembly and, yet would operate reliably and be manufactured at a modest expense. Thus, a need exists for a reliable mister-equipped umbrella system to enable a user to variably select a misting function to receive a steady supply of mist while being protected from the rays of the sun via an umbrella canopy and to avoid the above-mentioned problems.

BRIEF SUMMARY OF THE INVENTION

In view of the foregoing disadvantages inherent in the known umbrella art, the present invention provides a novel mister-equipped umbrella system. The general purpose of the present invention, which will be described subsequently in greater detail, is to provide a novel and durable umbrella comprising a mister assembly, an ergonomic handle, and possessing other unique characteristics for providing a user with optimal protection from all forms of precipitation and from harmful ultraviolet sun rays. Further, the present invention comprises an aesthetically appealing umbrella that may or may not be solar-powered.

A mister-equipped umbrella system as disclosed herein, in a preferred embodiment, comprising an umbrella assembly having an umbrella shaft, a tube, a runner, a plurality of stretchers, a plurality of ribs each terminating in a tip, a cover comprising at least one UV coating, a handle (having an inner volume for storing batteries and an outer surface for gripping), a fluid reservoir, a pump, a tube, and at least one mister. The umbrella shaft, the tube, the runner, the stretchers, the plurality of ribs, the cover, and the handle in combination form a collapsible umbrella assembly. Further, the umbrella shaft, the tube, the runner, the cover, and the plurality of ribs of the umbrella assembly are deployable from a closed-collected condition to an open condition to shield a user from at least one ambient environmental condition.

The mister in preferred embodiments may be mounted to the tube and the tube may serve to provide fluid communication between the fluid reservoir and the mister. The mister may be battery-powered via the batteries, or alternatively may draw power from a solar power source. The mister is designed to provide an atomized-mist (water—preferably deionized water, reverse osmosis water, to prevent calcium or mineral build up on and in the various components) pumped from the fluid reservoir via the pump, whereby the pump may be powered via the batteries or via the solar powering means. The mister in combination with the umbrella assembly of the mister-equipped umbrella system provides moisture about (on or around) the user to dissipate heat in a hot ambient environmental condition. The UV coating on the cover of the umbrella assembly may further protect the user by shielding him/her from UV rays, thereby promoting a healthy lifestyle in its users.

The user may deploy the collapsible umbrella assembly between a closed condition and an open condition in a conventional umbrella-opening manner by sliding a runner from a down-position to an up-position. Once the runner is manipulated into an up-position, the runner may lock into place via a first locking mechanism. The runner may be connected to a distal end of the plurality of ribs. The sliding motion opens up the cover by extending ribs of the cover outwardly. The collapsible umbrella assembly may be manipulated from an open condition to a closed condition by squeezing in the first locking mechanism and moving the runner from an up-position to a down-position. Once the runner has been manipulated into a down-position it may lock into place via a second locking mechanism. Squeezing the fastener again on the runner may allow for the movement of the runner from a down-position to an upward position. The various parts preferably comprise anti corrosive metal such as aluminum or the like (or non-metal such as plastic or the like) and may also further comprise a lining having an anti rust coating.

The mister-equipped umbrella further comprises a mister assembly, as previously indicated. The mister assembly generally comprises a fluid reservoir, a pump, a tube, and a mister head. The fluid reservoir comprises a canister for storing fluid, such as water which may comprise insulation means. The pump delivers the fluid via the tube to the mister head. In a preferred embodiment, the mister head comprises more than one misting option. For example, mister head comprises options for delivering a single spritz or an incremental (or non-incremental) mist spray. In use, the user may select one of the misting options via operating buttons on a handle of the umbrella.

Push button (operating buttons) may comprise hardened materials: rubber, plastic, silicon base, petroleum-based, plastic, or metal or combination thereof. The operating button(s) may be manually a) pressed once, twice, or multiple times; b) depress until mist is dispensed, depress to spray, depress to stop spray; c) may be black in color, multicolored, white in color, or clear; d) shape may be circular, octagonal, hexagonal, semicircular, linear, geometric or free form; e) placement may be on handle or along stem of the umbrella. The preferred button(s) used may be manually or electrically operated such as those knowledgeable in the art would readily appreciate use thereof. Rheostat-style buttons may be used to control the volume of fluid that may be dispensed.

By way of example the following button may be employed for use with the present invention: a pushbutton switch (a two-position device actuated with a button that is pressed and released). The pushbutton switch used herein preferably has an internal spring mechanism returning the button to its "out," or "unpressed," position, for momentary operation. Alternate pushbutton switches that may be used will latch alternately on or off with every push of the button. Other embodiments may use pushbutton switches which will stay in their "in," or "pressed," position until the button is pulled back out. The pushbutton switch may have a mushroom-shaped button for easy push-pull action. Buttons as described above are purely intended for enablement purposes and are not to be considered in any way limiting to the buttons that may be used. Selector switches may be used and when used may be actuated with a rotary knob or lever to select one of two or more positions. Selector switch when used can either rest in any of their positions or contain spring-return mechanisms for momentary operation.

The button(s) used may be manual or electrically operated as mentioned. On electric versions the button may be manipulated by being pressed and/or depressed, battery/batteries which may be used for activation may comprise AA, AAA, D, C. Batteries may comprise Lithium Ion versions, solar energy rechargeable batteries; batteries send a signal to the pump to activate or deactivate to cause water to flow or to not flow. Amount of water flowing may be regulated. Water/fluid is pushed or pulled into tubing/pipes located from the reservoir into tubing along the stem of the umbrella where it is dispensed into the mister where the water is concentrated into a fine mist and is dispensed to provide cooling for the user. The rotational mister may be used to change the angle of dispensed water as well as direction of the mist. Diameter of tubing can range from a few millimeters to a centimeter or under a centimeter. Length of the tubing ranges from a few inches up to under 50". The tubing may be one-piece or connected through one or more joints. If connected through joints tubing diameter may change. Joints may be flexible or inflexible and made out of the same materials as the flexible tubing, hoses, or plastic, PVC, or ABS pipes. Tubing is preferably durable to withstand extreme temperatures and will not melt or crack under normal ambient conditions. The button is pressed and the water travels in the tube then water is dispensed via the tubing it travels through.

Types of tubing may comprise flexible rubber tubing, flexible plastic tubing, flexible silicon-based hoses: nylon, polyurethane, polyethylene, rubber, plastic, PTFE, PVC, silicon-based pipes or ABS pipes. Tubing is in communication with the buttons and mister such that water can be transported as needed. Those with ordinary skill in the art will now appreciate that upon reading this specification and by their understanding the art of operating buttons, tubing as described herein, methods of manufacturing and using will be understood by those knowledgeable in such art.

The mister may be manipulated to spray in various patterns and in various quantities. In another embodiment, the mister-equipped umbrella may comprise an integrated cooler for cooling the fluid. In such a manner, the user may enjoy a steady supply of cool mist on a hot and sunny day.

In a preferred embodiment the umbrella handle functions as the battery holder as well as a means to hold and manipulate the umbrella. As such, the handle may be constructed from a rigid plastic such as ABS, and will be formed internally to support 2 to 4 AA size batteries. The handle will also have means for the user to access the batteries for replacement, and means to make electrical connection between the batteries and the switch and motor components. The batteries may be standard AA size alkaline batteries, and may comprise of 2 or 4 individual cells connected electrically in series.

Means to connect the cells in series is a function of the internal molding and contact wiring of the handle. The push button switch may be a custom construction or may be purchased, and will make electrical connection when pressed, typically designated as a normally open design. When the push button is depressed, the electrical circuit is closed and current will flow, energizing the electric pump motor. The pump mechanism comprises a motor to provide mechanical power and the pump mechanism to generate pressure on the water. The motor may be purchased from a vendor and implemented as a gear motor or may be direct drive. Gear reduction is necessary to provide high torque low speed required by the pump mechanism. The rotational motor output is applied to a mechanical arm, rack and pinion, or other mechanism for conversion of rotational movement to reciprocal movement necessary for the action of the pump.

Referring now to the water pump, it comprises a piston style pump similar to a hand held spray bottle. Pump action requires the plunger or piston to have sufficient force applied to generate adequate water pressure. The pump mechanism comprises a piston in a cylinder along with one or more check valves. The piston travels back and forth in its cylinder, being pushed and pulled in the cylinder by the motor mechanism, causing water to be pulled into and pushed out of the space inside the cylinder cavity. The check valve functions to direct the water flow from the cylinder cavity to the nozzle at the top of the umbrella when the piston is pushed into the cylinder, and water is drawn into the cylinder cavity when the piston is pulled out in the cylinder. The check valve may be a ball style check valve or flapper style check valve.

Water is drawn from the reservoir into the pump through a filter to prevent debris from entering the pump and possibly clogging the spray function. Water is supplied under pressure to the misting nozzle through a small diameter rigid tube.

The misting nozzle may be positioned towards the top of the umbrella shaft, and may include a swivel or other adjustable connection allowing the user to manipulate the direction in which misting occurs. The rigid tubing that supplies the misting nozzle with water may be routed inside of the fixed length (not telescoping) umbrella shaft, exiting the shaft at the top.

The handle may be injection molded ABS or other similar rigid thermoplastic, constructed to hold 2 or 4 AA cells with means to make electrical connections between the cells and connection to the motor and push button switch.

Push button switch may be constructed out of plastic and conductive non-ferrous metal or plated metals that accept solder connections for the electrical connection. The switch may be custom molded and stamped components, or may be purchased as a drop-in component from a number of vendors. Examples of drop-in switches may include the following: Mfg: Mountain Switch; PN: 104-0013-EVX Mfg: C&K Components; PN: 8532MZQE2.

The motor may be a gear reduction motor such as the following: Vendor: ServoCity; PN: 638256 or may be a direct drive motor such as the following: Mfg: Shenzhen A-OK Motor Co., Ltd. PN: FF-360SH-3840

Water reservoir is a custom designed 4 oz to 8 oz plastic bottle with a screw on cap made of high density polyethylene or similar molded plastic.

Small diameter rigid tube delivering water to the nozzle may be made of high density polyethylene or similar plastic, and may have inside diameter of 2 mm to 3 mm, and length of 40 mm to 60 mm.

Certain embodiments may comprise a digital clock with or without an illuminating means such that time may be displayed. A calendar may also be incorporated. A digital interval time indicator/interval selector/timer can allow the individual to select the time interval to which the mister is activated for mist dispensing. This timer may have the ability to digitally display the countdown till mist dispensing. The indicator/interval selector/timer may be powered by a separate battery and or solar panel or solar film.

The umbrella of the present invention may also comprise inversion prevention. Each canopy layer of the spiraled umbrella preferably overlaps and extends outwardly far enough to prevent rain from entering during a strong gust of wind when present. This mechanism along with a combination mesh/flap assembly located concentrically along the spiraled gaps provides support to the umbrella frame and serves to prevent inversion episodes during a windy environment. The flaps may be flat during normal conditions, but to prevent umbrella inversion may expand to allow optimal airflow of air trapped inside of the umbrella canopy. The flaps may connect the upper layer of the umbrella canopy to the middle layer. The lower flap may connect the middle layer of the umbrella to the lower layer of the canopy. The flaps are expandable in strong gusts of wind and expand in order to allow the trapped air inside the umbrella to escape. The stitching of the flaps allows the flaps to function in this way. The flaps may be stitched in one direction for the upper vent. The middle vent may be stitched in the opposing direction for added strength. The lower vent may be stitched in the same direction as the upper vent. This stitching may allow for the canopy to add strength to the umbrella frame and prevents the canopy from separating from the umbrella frame in sheer load. There may be 1, 2, or 3 vents, as desired by the manufacturer. The sun sensitive color change material may be stitched above and below the vents in a spiral fashion to add elegance.

The present invention holds significant improvements and serves as a mister-equipped umbrella system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, mister-equipped umbrella system, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a mister-equipped umbrella system and more particularly to a mister-equipped umbrella to shield a user from precipitation, to provide protection from harmful UV rays, and to allow a user to activate a mister having a variable-spray mist head to cool the user on a hot, sunny day.

Figures 1A, 1B:
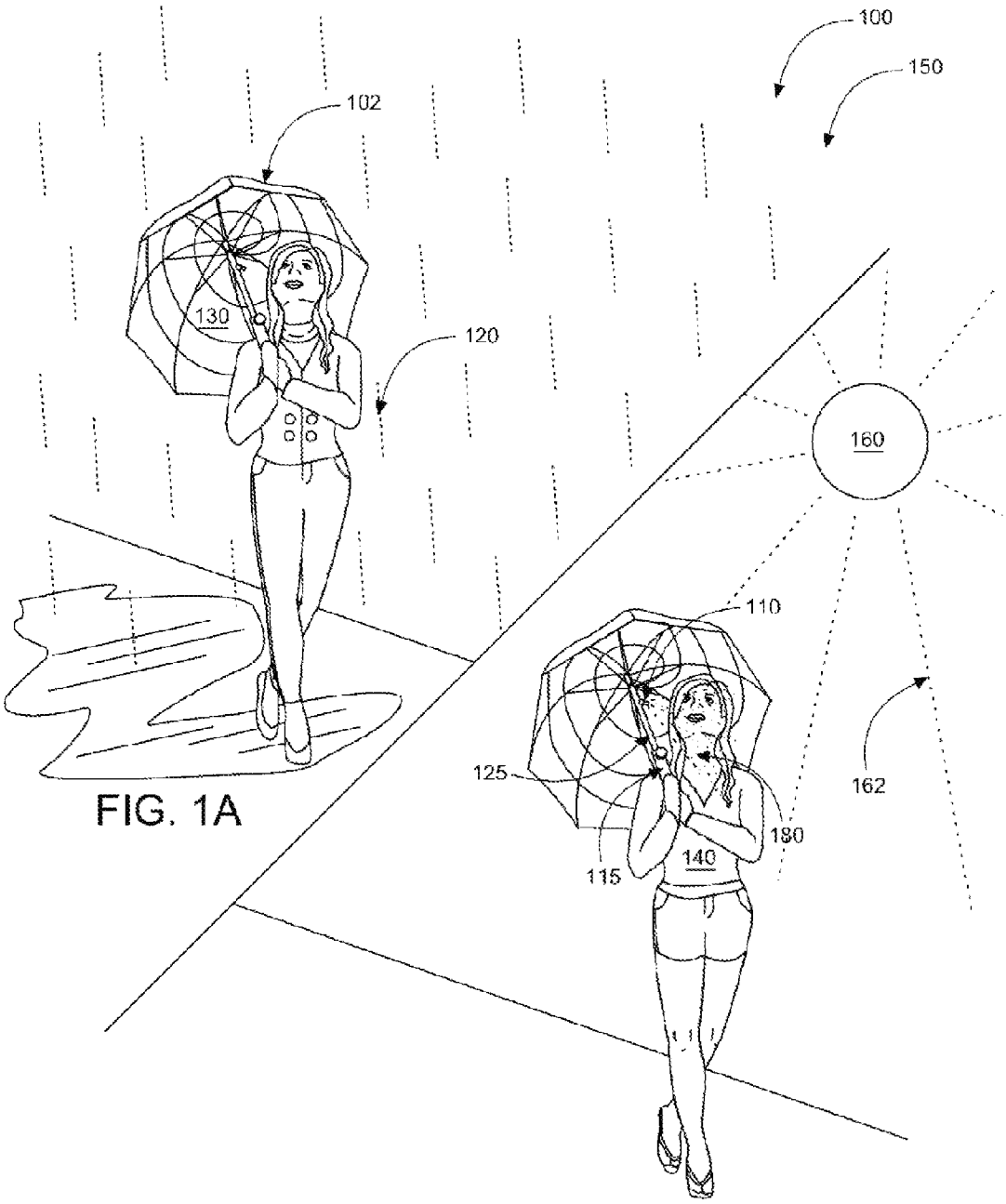
FIG. 1A shows a perspective view illustrating a mister-equipped umbrella in use shielding a user from getting wet with rain according to an embodiment of the present invention.
FIG. 1B shows a perspective illustrating the mister-equipped umbrella in use protecting a user from harmful ultraviolet rays while providing the user with a steady and cooling mist spray via a mister according to an embodiment of the present invention.

Referring now to the drawings by numerals of reference there is shown in FIGS. 1A and 1B, mister-equipped umbrella system 100 in an 'in-use' condition 150 according to an embodiment of the present invention. Mister-equipped umbrella system 100 comprises mister-equipped umbrella 102 which generally may comprise mister 110, handle 115, umbrella shaft 125, and cover 130. Handle 115 may comprise a grip for user 140 to hold mister-equipped umbrella 102. Umbrella shaft 125 may comprise a cylindrical shaped, hollow rod which may connect cover 130 to handle 115. In one embodiment, umbrella shaft 125 comprises durable, water-proof plastic. The durable, water-proof plastic material of umbrella shaft 125 may enable longer use of mister-equipped umbrella 102, while maintaining a light-weight for ease-of-use for user 140. The water-proof plastic may further prevent rusting from precipitation during 'in-use' condition 150. It should be appreciated that other suitably equivalent materials may be used and yet remain within the scope of this disclosure of the present invention.

As shown in FIG. 1A, user 140 may hold mister-equipped umbrella 102 via handle 115 such that user 140 is directly underneath cover 130. In such a manner, user 140 may be shielded from getting wet by rain 120 or other precipitation in an outdoor environment.

Referring now to FIG. 1B, illustrating mister-equipped umbrella system 100 in an 'in-use' condition 150. As shown, mister-equipped umbrella 102 may be used to protect user 140 from harmful UV rays 162 emitted by sun 160. In a preferred embodiment of the present invention, cover 130 may comprise a durable, water-proof cloth-like material. Cover 130 may further comprise a UV coating on both a top-side and an under-side of cover 130 to provide user 140 with additional protection from UV rays 162. UV coating may be sprayed (dipped or otherwise treated with) on both sides (top and under) of the device. This coating protects both user 140 and cover 130 from degradation, thereby promoting longevity and cost-effectiveness in-use. Further, mister-equipped umbrella 102 may comprise mister 110 for spraying mist 180. Mist 180 may provide user 140 with a cool misting spray on a hot, sunny day for additional comfort during use, as shown in FIG. 1B.

Figure 2A:
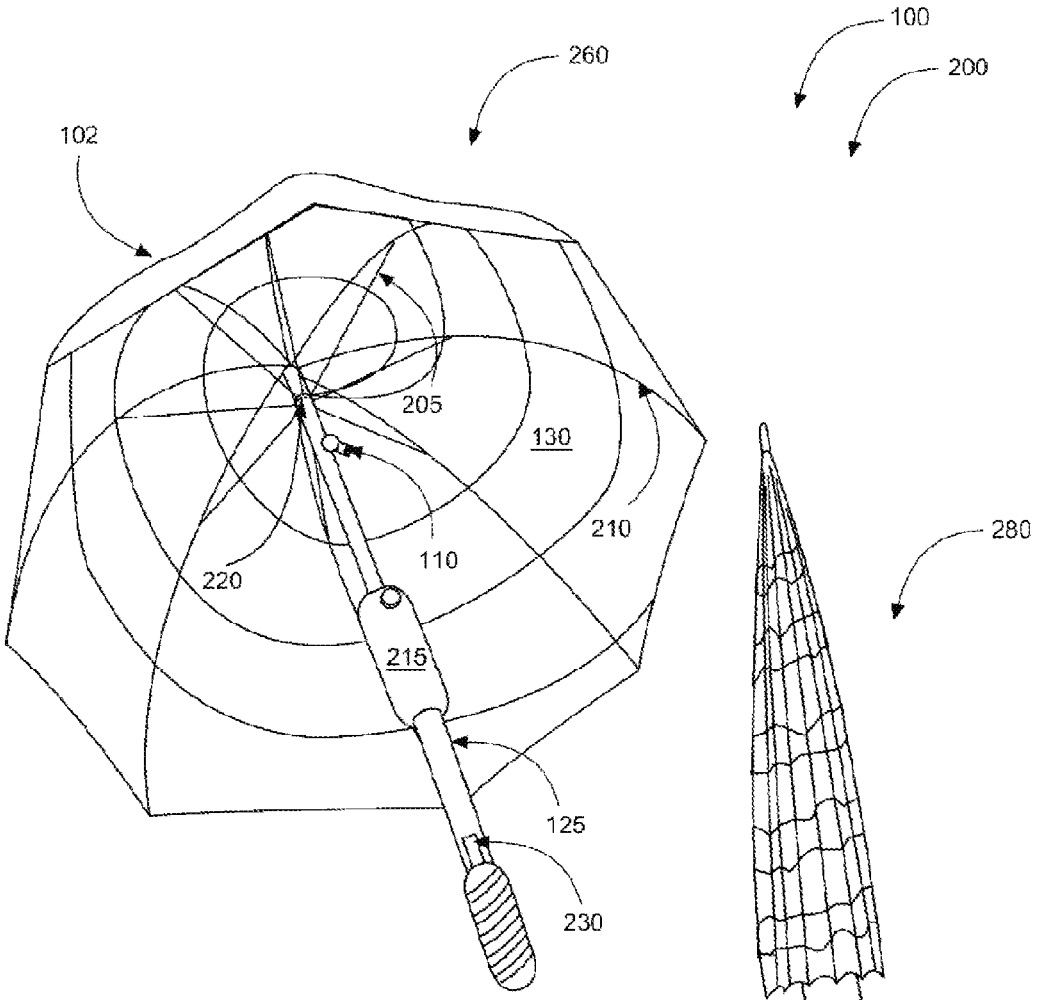
FIG. 2A is a perspective view illustrating the mister-equipped umbrella in an open-condition according to an embodiment of the present invention of FIGS. 1A and 1B.
Figure 2B:
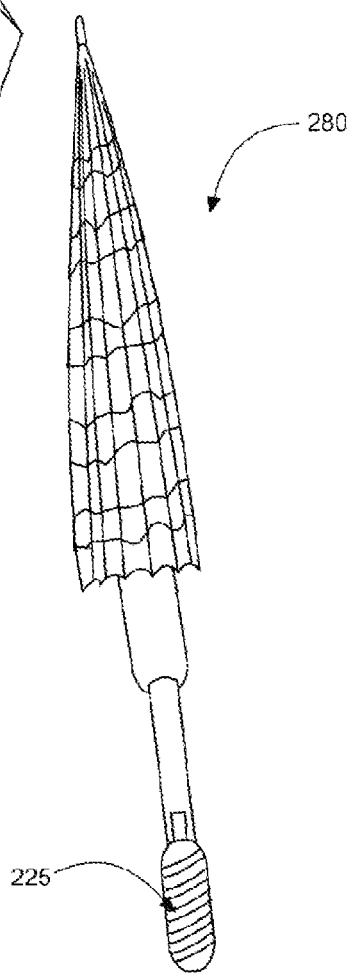
FIG. 2B is a perspective view illustrating the mister-equipped umbrella in a closed-condition according to an embodiment of the present invention of FIGS. 1A and 1B.

Referring to FIGS. 2A and 2B illustrating mister-equipped umbrella system 100 comprising mister-equipped umbrella assembly 200. FIG. 2A shows mister-equipped umbrella 102 in open condition 260 and FIG. 2B shows mister-equipped umbrella 102 in closed condition 280. Velcro® fasteners may be stitched into the fabric for closing mister-equipped umbrella 102 or a button cloth to secure umbrella when closed. Mister-equipped umbrella 102 may comprise mister-equipped umbrella assembly 102 which may generally comprise mister 110, handle 115, cover 130, stretchers 205, ribs 210, fluid reservoir 215, runner 220, and operating buttons 230. Runner 220 may comprise a circular-shaped disk which may be connected to stretchers 205 and ribs 210.

Ribs 210 may comprise inter-connected metal (or non-metal) spokes and may vary in lumen size. Further, stretchers 205 may be activated for extension by an electrical current via operating buttons 230. Once activated by user 140, ribs 210 expand until fully expanded. Another embodiment for some umbrella types may have a separate button for automatic positioning of mister 110. Mister 110 may have the ability to be positioned up, down, left or right by the touch of a four arrow/four position button that allows mister 110 to swivel upon its hinge.

In embodiments of the present invention, user 140 may transition mister-equipped umbrella 102 from closed condition 280 to open condition 260 by manually sliding runner 220 from a down position along umbrella shaft 125 to an up position. In such a manner, stretchers 205 comprising ribs 210 will cause cover 130 to be deployed, as best shown in FIG. 2A. Respectively, when user 140 wishes to close mister-equipped umbrella 102, user may manually slide runner 220 from the up position to the down position. In such a manner, stretchers 205 will cause cover 130 to become retracted. Alternatively and preferably, user 140 may open and close mister-equipped umbrella 102 via operating buttons 230. In such a manner, user 140 may press operating button 230 which may cause mister-equipped umbrella 102 to open, and user 140 may press operating button 230 which may cause mister-equipped umbrella 102 to close.

Handle 115 may comprise handle grip 225 providing an ergonomic gripping surface for user 140 to comfortably grip handle 115 during 'in-use' condition 150. In some embodiments of the present invention, handle 115 may comprise rubber so that it advantageously provides a stronger grip to user 140 of mister-equipped umbrella 102 thereby allowing greater security during windy, rainy, or a combination of windy and rainy conditions. Further, handle 115 may be constructed of an insulating rubber that may allow for insulating and grounding in the event of an electrical shock, such as a lighting strike. On one embodiment of the present invention, handle 115 may comprise operating buttons 230 which may be used by user 140 to operate mister 110. Alternatively, operating buttons 230 may be located along umbrella shaft 125 just above handle 115. The rubber handle is durable and will not melt with higher temperatures.

In still referring to FIGS. 2A and 2B, a first button of operating buttons 230 of mister-equipped umbrella 102 may deploy the traction and retraction of mister-equipped umbrella 102 between open condition 260 and closed condition 280. A second button of operating buttons 230 may be pressed by user 140 to release mist 180 from mister 110. In another embodiment of the present invention, operating buttons 230 may comprise a third button which may allow for height adjustment mister-equipped umbrella 102 by sliding cover 130 up and down along a track thereby raising or lowering cover 130 providing a variable height umbrella that may meet the height needs of user 140 comprising varying heights. While the embodiments described herein use the form "first", "second", and "third", it may be appreciated by those in the art that additional embodiments may include any number of operating buttons 230 providing some of the functionality of the buttons described herein. For example one operating button 230 may be used for mist dispensing control means or a third setting may be for continuous and a fourth setting comprising a deactivation of mister 110.

Figure 3:
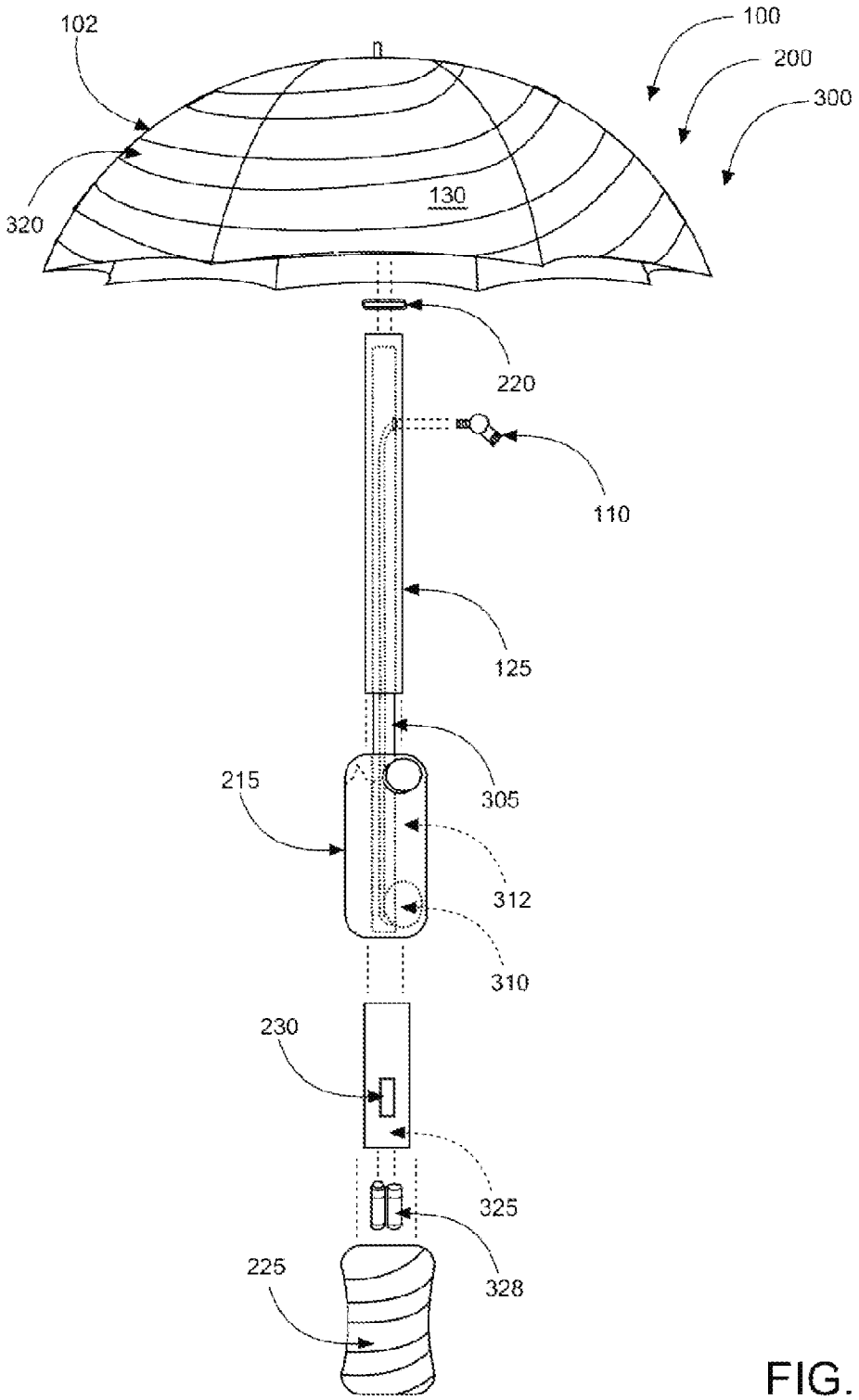
FIG. 3 is an exploded view illustrating the mister-equipped umbrella integrally comprising a fluid pump and a power source according to an embodiment of the present invention of FIGS. 1A and 1B.

Referring now to FIG. 3, illustrating exploded view 300 of mister-equipped umbrella system 100 according to an embodiment of the present invention of FIGS. 1A and 1B. As shown, mister-equipped umbrella system 100 comprises mister-equipped umbrella assembly 200. Mister-equipped umbrella 102 may comprise umbrella shaft 125 which may integrally comprise tube 305 and fluid pump 310. Tube 305 may comprise a flexible hose which may provide fluid communication between fluid reservoir 215 holding fluid 312 and mister 110. Fluid pump 310 may comprise a pump for providing a pressurized means (hydraulic force) for delivering fluid 312 to mister 110 via tube 305.

In continuing to refer to FIG. 3, handle 115 may integrally comprise battery compartment 325. Battery compartment 325 may comprise a housing for holding batteries 328. In one embodiment, batteries 328 may comprise at least two AA batteries. Batteries 328 may serve to provide power to operating buttons 230 which may control fluid pump 310, mister 110, and deploying and retracting cover 130 of mister-equipped umbrella 102.

Further, it should be appreciated that cover 130 of mister-equipped umbrella 102 may comprise UV coating 320, as shown in FIG. 3. UV coating 320 may comprise a surface treatment to cover 130 of mister-equipped umbrella 102 which may be cured by ultraviolet radiation to protect material of 130 from harmful effects caused by UV rays 162. UV coating 320 may be formulated up to 100% solids so that they have no volatile component that contributes to pollution. UV coating 320 may be applied to cover 130 via most conventional industrial coating applications as well as by silkscreen. Preferably, UV coating 320 may be applied to both a top side and an underside of cover 130 preferably via a water-borne formulation that is environmentally friendly.

In an embodiment of mister-equipped umbrella 102, cover 130 may comprise photochromic material sensitive to sunlight intensity. In such a manner, the photochromic material may enable cover 130 to be temperature sensitive and allow for color changes and design appearance to change based on outdoor temperatures a novel and appealing feature for umbrella users. When sunlight or ultraviolet (UV) radiation is applied to cover 130, the dye becomes excited and the molecular structure is changed allowing a specific color to appear. For example, when UV rays 162 strikes cover 130, cover 130 may change to the color yellow (Asian yellow), an especially desirable color to oriental persons, persons whom also have an affinity to use of umbrellas, but who do not prefer black since it is dull and may hold negative cultural significance as a color. This photochromic material may be stitched in certain locations on the canopy (cover 130) (such as in a spiral direction) or may cover the entire canopy with one or more color changing photochromic colors.

When the stimulus from UV rays 162 is removed, the dye will return to a state of rest, which is its colorless form such that it may return to a specified initial (unexcited condition) color such as green (or other preferred color) for example. In addition, cover 130 comprising photochromic material may allow individuals to have standard designs or allow user(s) 140 to add personal designs to mister-equipped umbrella 102. It should be appreciated that photochromic material of cover 130 may turn a variety of colors according to a limited color spectrum based upon preference of user 140.

Fluid reservoir 215 may comprise a plurality of threads such that fluid reservoir 215 is readily removably attachable to mister-equipped umbrella 102 such that it may be filled with ease and re-installed for use. Mister-equipped umbrella assembly 200 may additionally comprise mister installation assembly 400 comprising fluid pump 310, tube 305, and mister 110. Mister 110 may comprise mister head 410 having a variable mist control for providing at least two different mist settings (fine/course spray) of mister 110. Other mist settings may be achieved when angles are changed (via rotation) such that spray is caused to collide, to run parallel or the like. In certain embodiments the fluid reservoir 215 is fixed and non-removable with a screw cap for introducing fluid 312 such that it is not easily broken as in removable versions. In this particular embodiment the umbrella frame and fluid reservoir 215 are securely connected and are continuous as one piece, to prevent breakage from the reservoir/stem assembly.

In an embodiment of the present invention, mister-equipped umbrella 102 may comprise a specialized handle-locking device which may secure mister-equipped umbrella 102 in place. Further, mister-equipped umbrella 102 may comprise a cooling mechanism. The cooling mechanism may cool fluid 312 dispensed by mister 110. As shown best in FIG. 2A, mister-equipped umbrella 102 may comprise fluid reservoir 215 for storing fluid 312. Preferably, fluid 312 comprises water. Alternatively, fluid 312 may comprise (non-toxic) gel, cooling polymer, or other suitable cooling material and may comprise additives that deter rusting/corrosion and mineral buildup to prevent clogging. A transparent water level indicator on water reservoir 215 can show when the water level to be added. This can be a simple indicator such as how an iron shows the water level or can more complex such as a light signal when the water level is low, and filling is required when mister 110 is activated for use.

In an alternate embodiment of the present invention, mister-equipped umbrella 102 may comprise a supporting compartment which may allow user 140 to store personal items in mister-equipped umbrella 102 while traveling. The supporting compartment may comprise a hollowed out area within umbrella shaft 125 or multiple pouches located within the outer surface of the canopy. This pouch or series of multiple pouches, may serve as a water-resistant/waterproof compartment for storage of small lightweight items. This pouch may have a button or Velcro (hook and loop) fastener and may be expandable.

In yet another embodiment of the present invention, mister-equipped umbrella 102 may comprise a plurality of fans (not shown); however this version isn't preferred due to the additional power requirements. The fans may provide an additional cooling means for user 140 in addition to mister 110. The plurality of fans may be attached to umbrella shaft 125 and may receive operating power from batteries 328 or from a solar power source. The solar powering source may comprise a photovoltaic module installed to an outer portion of umbrella shaft 125 whereby the photovoltaic module may draw solar energy from sun 160 to operate the fans.

In a further alternate embodiment of mister-equipped umbrella system 100, mister-equipped umbrella 102 may comprise an attachment to attach mister-equipped umbrella 102 to a back pack or nap sack (shown in FIG. 8A). In such a manner, mister-equipped umbrella 102 may provide hands-free protection to user 140 from at least one ambient condition while further providing user 140 with mist 180 from mister 110. This embodiment may provide user 140 with a convenient, hands-free mister-equipped umbrella 102 while carrying personal effects in the back pack or nap sack. In this way the present invention may be hands-free permitting user 140 to read or the like while walking.

Figure 4:
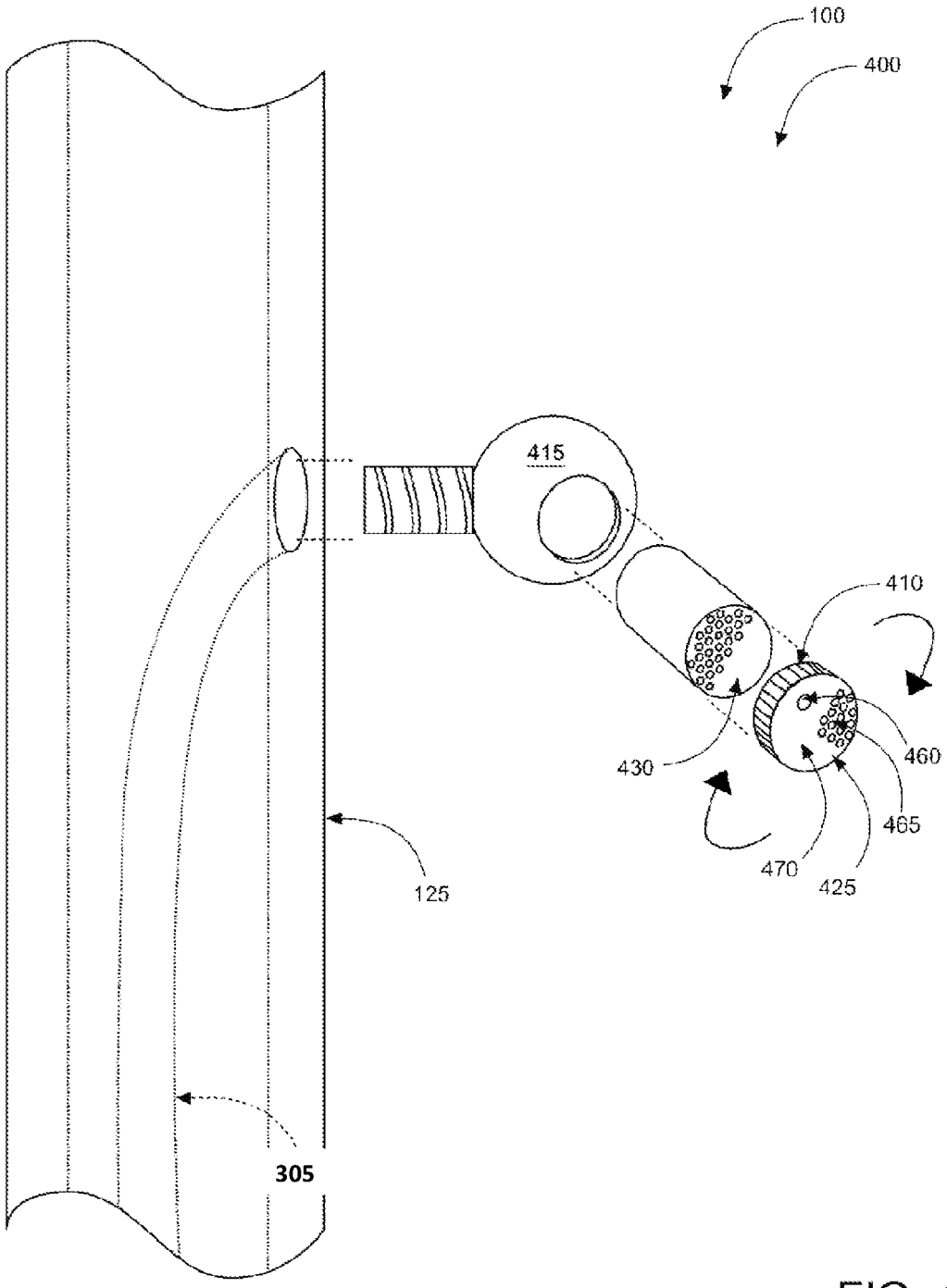
FIG. 4 is a perspective view illustrating a mister head enabling varying mist spray capabilities according to an embodiment of the present invention of FIGS. 1A-1B and 3.

Referring now to FIG. 4, illustrating a perspective view of mister installation assembly 400 of mister-equipped umbrella system 100 according to an embodiment of the present invention of FIGS. 1A and 1B.

As shown, mister installation assembly 400 may comprise mister 110 comprising mister head 410, and ball and socket 415. In one embodiment, mister head 410 is located at an upper portion of umbrella shaft 125 and may be in electrical communication via electronic cables (not shown). As shown, mister head 410 may be threadably inserted into a ball component of ball and socket 415. Further, a socket component of ball and socket 415 may be connected to tube 305. In such a manner, mister head 410 may be in fluid communication with fluid reservoir 215 via pressurized force applied by fluid pump 310. Further, mister head 410 may be pivotable via ball and socket 415 (or other suitably equivalent pivoting means) such that user 140 may manually adjust mister 110 to a user-preferred orientation during use of mister-equipped umbrella 102. For example in windy conditions user 140 may direct mist 180 forwardly such that mist 180 (water) sprays on user 140 when the wind is blowing in calm conditions user 140 may direct mister head 410 directly onto his/her person.

In continuing to refer to FIG. 4, mister head 410 may comprise outer face 425 and inner face 430. Outer face 425 and inner face 430 may be joined together (slidably-coupled in relation to each other) to providing various settings of mist 180. In one setting, user 140 may manually manipulate outer face 425 to provide for single spritz 460. In another setting, user 140 may manually manipulate outer face 425 to provide for mist spray 465. Alternatively, user 140 may manually manipulate outer face 425 for closed spray 470 thereby ceasing operations of mister 110. User 140 may manipulate mister head 410 by turning outer face 425 clockwise and counter-clockwise with respect to inner face 430. This feature in conjunction with use of operating buttons 230 permits user 140 to set the device to provide mist at a comfortable pace/volume/location. Mister(s) 110 may be present above runner 220 when the umbrella canopy is in a fully expanded position. This strategic position prevents damage to mister assembly 400 and hoses during umbrella assembly 102 opening and closing. When umbrella assembly 102 fully collapses, the movement of the canopy touching mister 110 will allow for mister 110 to fold inward and in parallel or almost in parallel to tube 305 (umbrella stem) on its pivotal hinge preventing mister 110 from piercing through the cover.

In one embodiment of the present invention, mister-equipped umbrella 102 may comprise a rheostat to select misting intensity. The rheostat may comprise a two-terminal variable resistor for varying resistance in power supplied to fluid pump 310. In such a manner, user 140 may adjust the intensity and the frequency of mister 110 to receive a user-preferred mist 180 during 'in-use' condition 150, as shown in FIG. 1B.

Figure 5A:
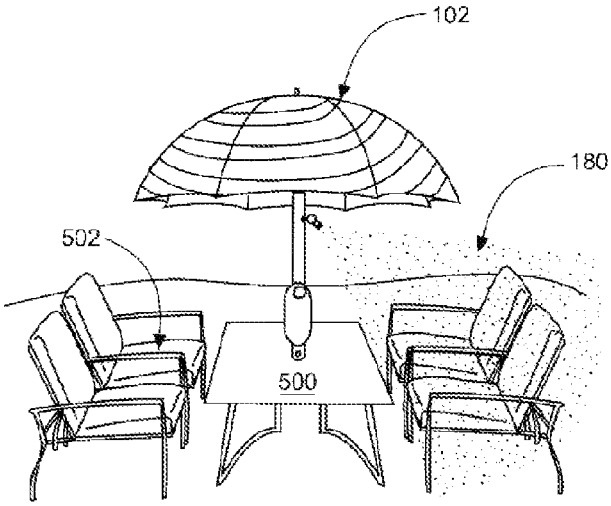
FIGS. 5A-5D shows perspective views of various uses of the mister-equipped umbrella according to alternative embodiments of the present invention.

Referring now to FIGS. 5A-5D, and 8A-8B illustrating various hands-free uses of mister-equipped umbrella system 100. As shown in FIG. 5A, mister-equipped umbrella 102 may be installed to furniture 502, such as patio table 500. In such a manner, mister-equipped umbrella 102 may be provide a stationary canopy which may be enjoyed by user 140 sitting in a backyard of his or her home on a hot, sunny day. User 140 may activate mister 110 of mister-equipped umbrella 102 to enjoy a cooling sensation provided by mist 180. Motors may be used to power this specific embodiment and a plurality of misters 110 can be moved (manipulated) to direct onto various users 140. Misters 110 can be fixed in place via a hinge and the direction can be up, down, side to side. FIG. 8A is a side perspective view of mister-equipped umbrella assembly 102 as used on backpack embodiment 800 with backpack attacher 810 in 'in-use' condition 850 according to an embodiment of the present invention of FIGS. 1A-1B. FIG. 8B shows mister-equipped umbrella chair 860. Mister-equipped umbrella chair 860 comprises furniture 502 as do the items shown in FIGS. 5A-5D.

Figure 5C:
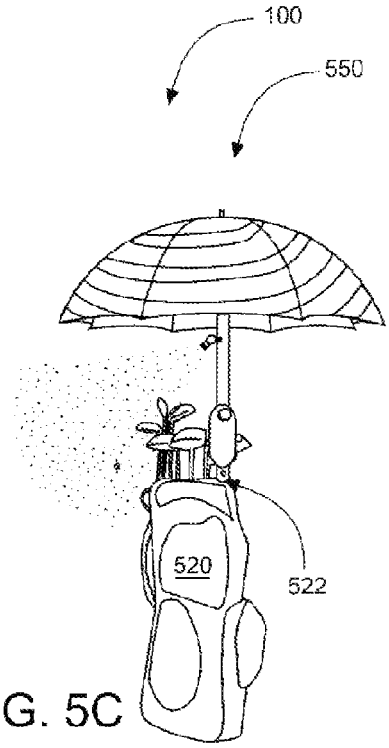
Figure 5B:
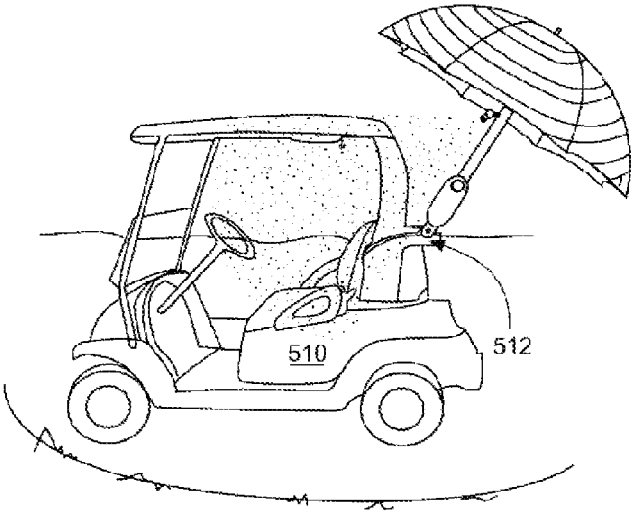

In referring now to FIG. 5B, illustrating how mister-equipped umbrella 102 may be threaded via spirals or otherwise attached to a rear portion of golf cart 510 via golf cart attacher 512. In such a manner, cover 130 of mister-equipped umbrella 102 may provide user 140 of driving golf cart 510 with additional protection from sun 160 while spraying a steady mist 180 to occupants within golf cart 510 while driving around a golf course. In this application operating button 230 may be pressed once for single spray; twice for intermittent; three times for continuous (may also be this way for patio versions). Operating button 230 may be pressed once more for 'off'.

In referring now to FIG. 5C, illustrating how mister-equipped umbrella 102 may be attached to golf bag 520 via golf bag attacher 522. In such a manner, user 140 carrying golf bag 520 may enjoy additional protection from sun 160 while being comforted by mist 180 from mister 110. Furthermore, cover 130 of mister-equipped umbrella 102 may prevent golf clubs from getting too hot from sun 160, thereby prolonging the life of the golf clubs while keeping them cool for use by user 140.

Figure 5D:
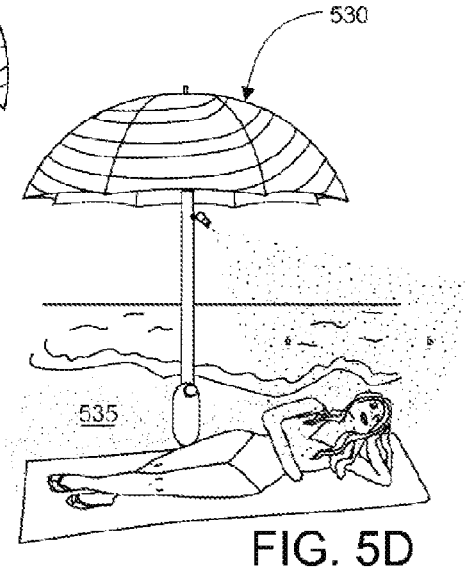

In referring now to FIG. 5D, illustrating mister-equipped umbrella 102 comprising parasol 530 for use by user 140 comprising a sunbather while laying on beach 535. In such a manner, parasol 530 may be inserted into sand from beach 535 such that parasol 530 is supported in an upright position. User 140 may then rest underneath cover 130 of parasol 530 and enjoy a steady mist 180 from mister 110. This may help keep user 140 cool and comfortable while soaking in sun 160 on beach 535. Certain embodiments may be connected to a stationary pressurized water source such as a hydrant.

Cover 130 preferably comprises UV coating 320 on a top-side of cover 130, cover 130 further comprising a second UV coating 320 on an underside of cover 130 providing redundant protection from UV rays 162, whereby a top-side of co cover 130 may be treated with a photochromic dye. The photochromic dye may change colors according to a limited color spectrum as a result of a temperature change which may also find usefulness in advertising for example changing from yellow to blue that may be the colors of a suntan spray for example.

Figure 6:
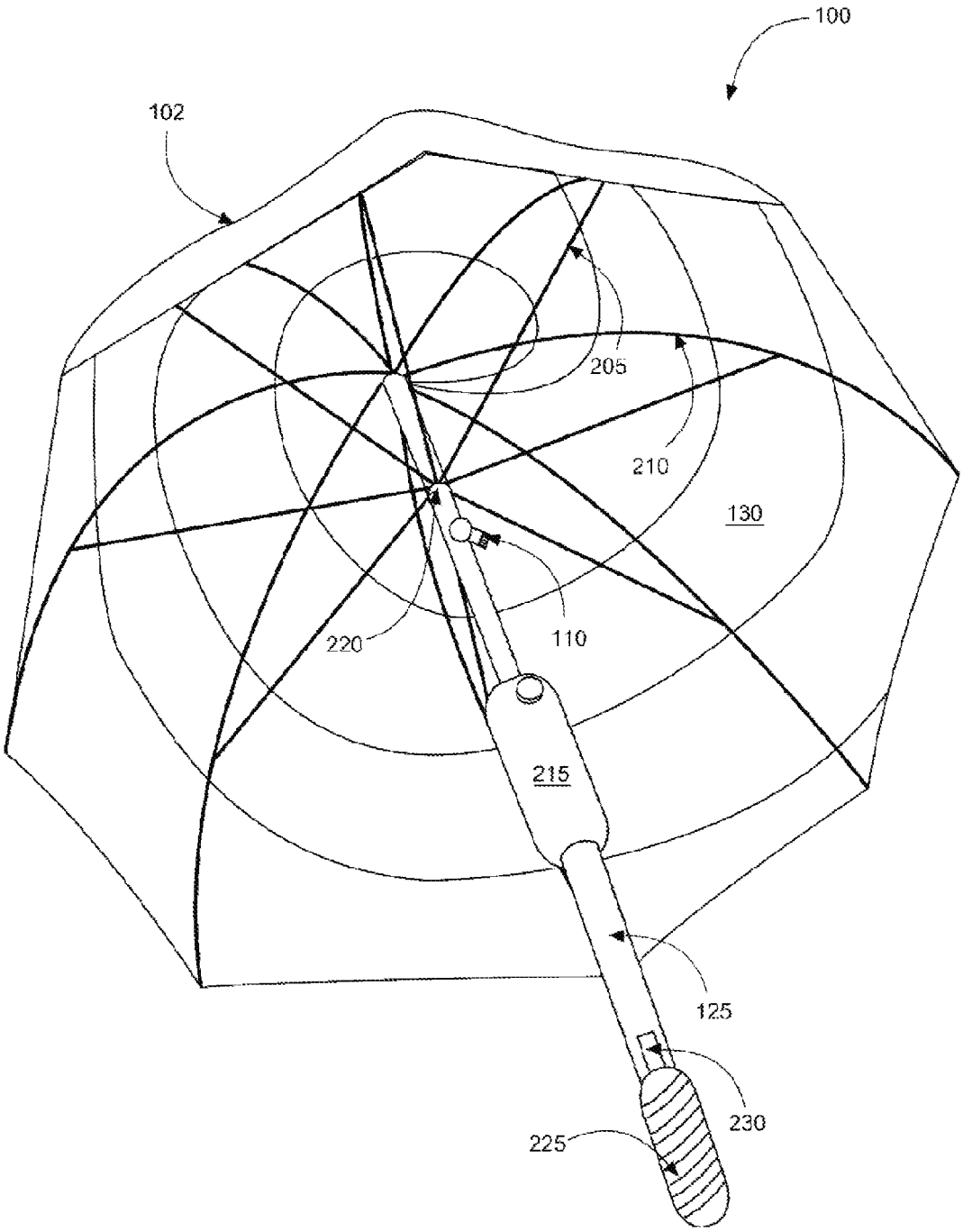
FIG. 6 is an underside perspective view illustrating the mister-equipped umbrella according to an embodiment of the present invention of FIGS. 1A-1B.

FIG. 6 is an underside perspective view illustrating umbrella assembly 102 according to a non-invertible cover assembly 600 embodiment of the present invention of FIGS. 1A-1B. Screw cap 610 is shown as attached to fluid reservoir 215.

Figure 7:
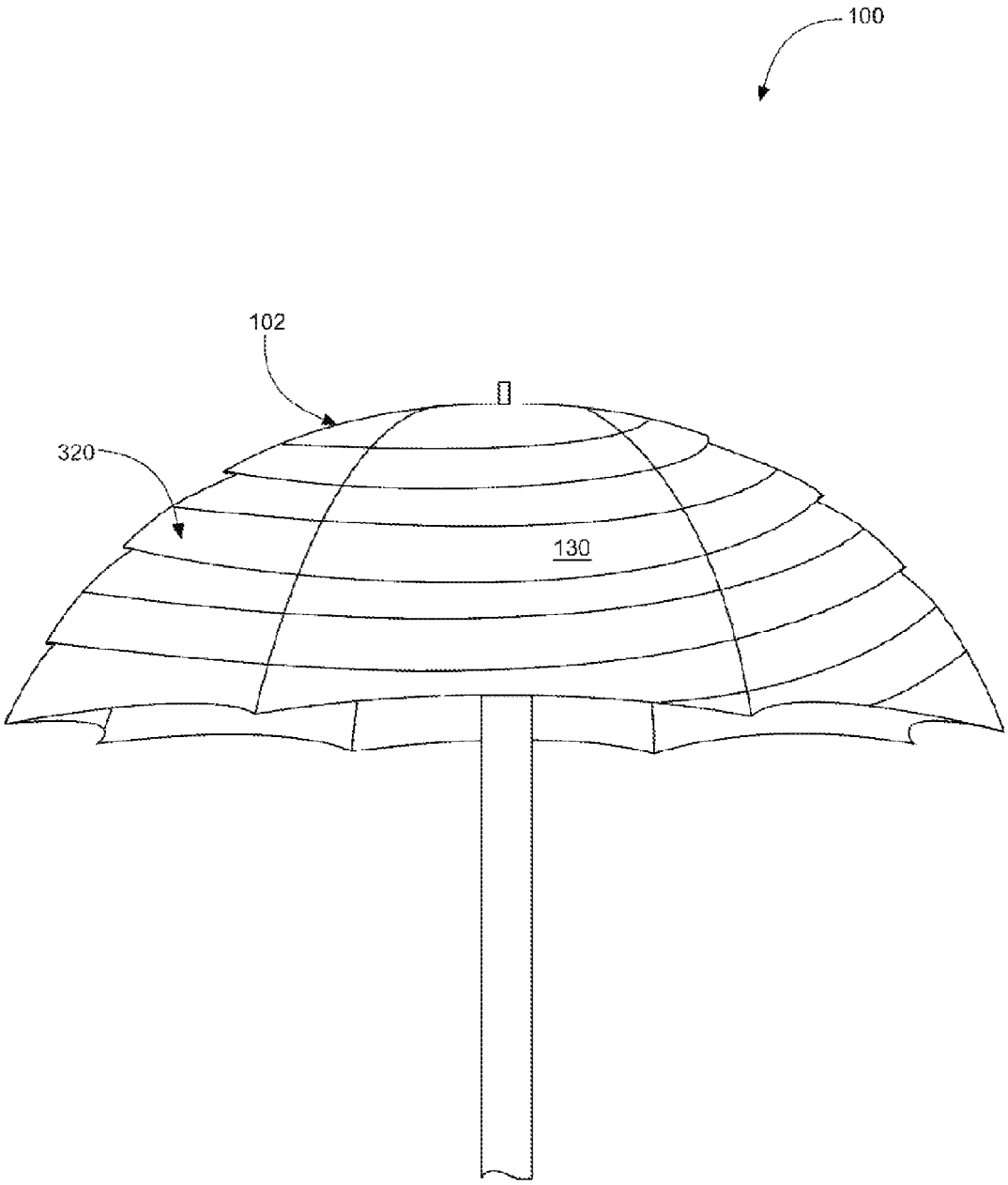
FIG. 7 is a side perspective view illustrating venting to prevent inversion as used on the mister-equipped umbrella according to an embodiment of the present invention of FIGS. 1A-1B.

FIG. 7 is a side perspective view illustrating venting (vents 705) to prevent inversion as used on umbrella assembly 102 according to an embodiment of the present invention of FIGS. 1A-1B. There may be 1, 2, or 3 vents 705, as desired by the manufacturer; vents 705 designed to prevent inversion as discussed previously. UV coating 320 is also indicated.

Figure 8:
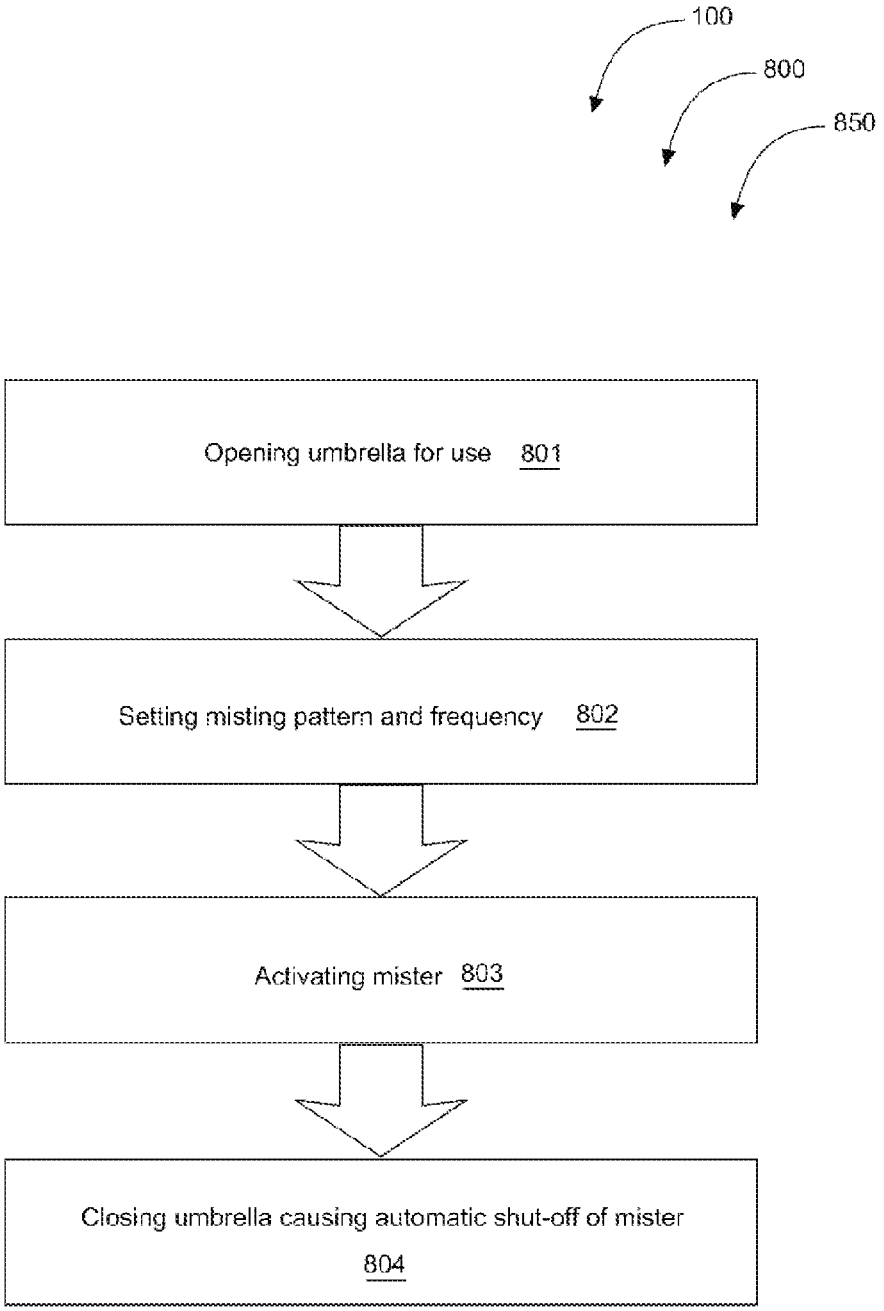
FIG. 8 is a flowchart illustrating a method of use according to an embodiment of the present invention of FIGS. 1A-7.

Referring now to FIG. 8, illustrating flowchart 950 comprising method of use 900 of mister-equipped umbrella system 100 according to an embodiment of the present invention.

Method of use 900 may comprise the steps of: step one 901 opening mister-equipped umbrella 102 by sliding runner 220 from a down position to an up position along umbrella shaft 125 thereby deploying cover 130; step two 902 setting a misting pattern and a misting frequency of mister 110; step three 903 activating mister 110 via operating buttons 230; and step four 904 closing mister-equipped umbrella 102 by sliding runner 220 from the up-position to the down-position thereby retracting cover 130.

It should be noted that upon performing step four 904 of closing mister-equipped umbrella 102, mister 110 will shut off automatically via a shutoff lever. In such a manner, mister 110 will never release mist 180 when in closed condition 280.

It should also be noted that the steps described in the method of use can be carried out in many different orders according to user preference. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A mister-equipped umbrella system comprising:

a shaft having an intermediate portion extending between a handle portion and an upper portion;

a plurality of stretchers projecting from a runner slidably coupled to the intermediate portion of the shaft to a plurality of ribs for displacement thereof between extended and collapsed configurations relative to the shaft responsive to displacement of the runner along the intermediate portion of the shaft;

a canopy flexibly extending over the ribs to be extended and collapsed therewith;

a reservoir coupled to the shaft for storing a misting liquid;

a mister installation assembly adjustably coupled to the upper portion of the shaft, the mister installation assembly including a mister head disposed in fluid communication with the reservoir through the intermediate portion of the shaft for dispensing the misting liquid therefrom in selectively adjustable manner, wherein the mister head is disposed adjacent the shaft to define a low profile against impeding displacement of the canopy between the extended and collapsed configurations thereof; and, an actuation button disposed on at least one of the handle portion and reservoir for selective control of misting liquid dispensing from the mister head;

wherein the mister head is coupled in pivotally hinged manner with respect to the upper portion of the shaft for adaptively pivoted displacement to accommodate the collapsed configuration of the canopy; and, the mister head includes:

an inner portion defining an inner dispensing chamber; and, an outer portion coupled in adjustably displaceable manner to the inner portion, the outer portion defining an outer dispensing face extending across to cover the inner dispensing chamber, the outer dispensing face defining a plurality of openings for pressurized expulsion of the misting liquid from the inner dispensing chamber therethrough.

2. The mister-equipped umbrella system as recited in claim 1, wherein the mister installation assembly includes a ball and socket portion adjustably coupled to the upper portion of the shaft, the mister head being detachably coupled to the ball and socket portion to be adjustable in angular orientation relative to the shaft.

3. The mister-equipped umbrella system as recited in claim 1, wherein the outer portion of the mister head is selectively displaceable in axial position relative to the inner portion thereof, the outer dispensing face being formed to include:

a close region defining a solid planar surface;

a single spritz region defining a single opening in a planar surface; and, a mist spray region defining a plurality of misting openings each less in opening size than the single opening of the single spritz region.

4. The mister-equipped umbrella system as recited in claim 1, further comprising a fluid pump in fluid communication with the reservoir for pumping the misting liquid therefrom to the mister head.

5. The mister-equipped umbrella system as recited in claim 4, further comprising a power source coupled to the fluid pump, the power source energizing the fluid pump for automatic activation responsive to the actuation button.

6. The mister-equipped umbrella system as recited in claim 5, wherein the power source is disposed in the shaft, the power source being selected from the group consisting of: a battery driven electrical source and a solar power source.

7. A mister-equipped umbrella system comprising:

a shaft having an intermediate portion extending between a handle portion and an upper portion;

a plurality of stretchers projecting from a runner slidably coupled to the intermediate portion of the shaft to a plurality of ribs for displacement thereof between extended and collapsed configurations relative to the shaft responsive to displacement of the runner along the intermediate portion of the shaft;

a canopy flexibly extending over the ribs to be extended and collapsed therewith;

a reservoir coupled to the shaft for storing a misting liquid;

a mister installation assembly adjustably coupled to the upper portion of the shaft, the mister installation assembly including a mister head disposed in fluid communication with the reservoir through the intermediate portion of the shaft for dispensing the misting liquid therefrom in selectively adjustable manner, wherein the mister head is disposed adjacent the shaft to define a low profile against impeding displacement of the canopy between the extended and collapsed configurations thereof; and, an actuation button disposed on at least one of the handle portion and reservoir for selective control of misting liquid dispensing from the mister head;

wherein the mister head is coupled in pivotally hinged manner with respect to the upper portion of the shaft for adaptively pivoted displacement to accommodate the collapsed configuration of the canopy; and, the canopy is formed with a plurality of spirally defined canopy portions delineated by spirally extending gaps for ventilation therebetween.

8. The mister-equipped umbrella system as recited in claim 7, wherein the spirally defined canopy portions include at least one sun-sensitive color change material applied thereto.

9. A mister-equipped umbrella system comprising:

a shaft having an intermediate portion extending between a handle portion and an upper portion;

a plurality of stretchers projecting from a runner slidably coupled to the intermediate portion of the shaft to a plurality of ribs for displacement thereof between extended and collapsed configurations relative to the shaft responsive to displacement of the runner along the intermediate portion of the shaft;

a canopy flexibly extending over the ribs to be extended and collapsed therewith;

a reservoir coupled to the shaft for storing a misting liquid;

a mister installation assembly adjustably coupled to the upper portion of the shaft, the mister installation assembly including a mister head disposed in fluid communication with the reservoir through the intermediate portion of the shaft for dispensing the misting liquid therefrom in selectively adjustable manner, wherein the mister head is disposed adjacent the shaft to define a low profile against impeding displacement of the canopy between the extended and collapsed configurations thereof; and, an actuation button disposed on at least one of the handle portion and reservoir for selective control of misting liquid dispensing from the mister head;

wherein the mister installation assembly includes a ball and socket portion adjustably coupled to the upper portion of the shaft, the mister head being detachably coupled to the ball and socket portion to be pivotally hinged thereby for adjustment in angular position relative to the shaft; and, the mister head includes:

an inner portion defining an inner dispensing chamber; and, an outer portion coupled in adjustably displaceable manner to the inner portion, the outer portion defining an outer dispensing face extending across to cover the inner dispensing chamber, the outer dispensing face defining a plurality of openings for pressurized expulsion of the misting liquid from the inner dispensing chamber therethrough.

10. The mister-equipped umbrella system as recited in claim 9, wherein the outer portion of the mister head is selectively displaceable in angular position relative to the inner portion thereof, the plurality of regions being angularly offset about the outer dispensing face to include:

a close region defining a solid planar surface;

a single spritz region defining a single opening in a planar surface; and, a mist spray region defining a plurality of misting openings each less in opening size than the single opening of the single spritz region.

11. The mister-equipped umbrella system as recited in claim 9, further comprising a fluid pump in fluid communication with the reservoir for pumping the misting liquid therefrom to the mister head.

12. The mister-equipped umbrella system as recited in claim 11, further comprising a power source coupled to the fluid pump, the power source energizing the fluid pump for automatic activation responsive to the actuation button.

13. The mister-equipped umbrella system as recited in claim 12, wherein the power source is disposed in the shaft, the power source being selected from the group consisting of: a battery driven electrical source and a solar power source.

14. The mister-equipped umbrella system as recited in claim 11, wherein the canopy is formed with a plurality of spirally defined canopy portions delineated by spirally extending gaps for ventilation therebetween, at least one of the spirally defined canopy portions including a sun-sensitive color change material and a UV coating applied thereto.

15. A mister-equipped umbrella system comprising:

a shaft having an intermediate portion extending between a handle portion and an upper portion;

a plurality of stretchers projecting from a runner slidably coupled to the intermediate portion of the shaft to a plurality of ribs for displacement thereof between extended and collapsed configurations relative to the shaft responsive to displacement of the runner along the intermediate portion of the shaft;

a canopy flexibly extending over the ribs to be extended and collapsed therewith;

a reservoir coupled to the shaft for storing a misting liquid;

a mister installation assembly adjustably coupled to the upper portion of the shaft, the mister installation assembly including a mister head disposed in fluid communication with the reservoir through the intermediate portion of the shaft for dispensing the misting liquid therefrom in selectively adjustable manner, wherein the mister head is disposed adjacent the shaft to define a low profile against impeding displacement of the canopy between the extended and collapsed configurations thereof; and, a fluid pump in fluid communication with the reservoir for pumping the misting liquid therefrom to the mister head, the fluid pump being energized for activation by a power source coupled thereto responsive to the actuation button; and, an actuation button disposed on at least one of the handle portion and reservoir for selective control of misting liquid dispensing from the mister head;

wherein the canopy is formed with a plurality of spirally defined canopy portions delineated by spirally extending gaps for ventilation therebetween;

wherein the mister installation assembly includes a ball and socket portion adjustably coupled to the upper portion of the shaft, the mister head being detachably coupled to the ball and socket portion to be pivotally hinged thereby for adjustment in angular position relative to the shaft.

16. The mister-equipped umbrella system as recited in claim 15, wherein the mister head includes:

an inner portion defining an inner dispensing chamber; and, an outer portion coupled in adjustably displaceable manner to the inner portion, the outer portion defining an outer dispensing face extending across to cover the inner dispensing chamber, the outer dispensing face defining a plurality of openings for pressurized expulsion of the misting liquid from the inner dispensing chamber therethrough.

17. The mister-equipped umbrella system as recited in claim 16, wherein the power source is disposed in the shaft, the power source being selected from the group consisting of: a battery driven electrical source and a solar power source.

* * * * *